United States Patent [19]

Wright et al.

[11] 4,094,230

[45] June 13, 1978

[54] SELF-ALIGNING AND END FIXITY CONNECTOR FOR CONNECTING A HYDRAULIC CYLINDER PISTON ROD TO ITS RESPECTIVE SECTION IN A MULTI-SECTION TELESCOPIC BOOM ASSEMBLY

[75] Inventors: William E. Wright; Huber D. Bock, Jr., both of Hagerstown, Md.

[73] Assignee: Walter Kidde & Company, Inc., Clifton, N.J.

[21] Appl. No.: 760,323

[22] Filed: Jan. 18, 1977

Related U.S. Application Data

[63] Continuation of Ser. No. 511,606, Oct. 3, 1974, abandoned.

[51] Int. Cl.[2] ..... F01B 7/20; F01B 1/00

[52] U.S. Cl. ..... 92/51; 92/66; 92/118; 92/161; 92/165 PR; 212/55

[58] Field of Search ..... 91/167 R; 92/62, 66, 92/52, 53, 117 R, 117 A, 118, 146, 51, 161, 165 PR; 212/55; 214/141

[56] References Cited

U.S. PATENT DOCUMENTS

| | | | |
|---|---|---|---|
| 2,821,316 | 1/1958 | Saint | 91/167 R |
| 3,477,229 | 11/1969 | Katko | 91/167 R |
| 3,534,664 | 10/1970 | Ulinski | 92/146 |
| 3,658,189 | 4/1972 | Brown et al. | 92/52 |
| 3,777,629 | 12/1973 | Johnston | 92/146 |

OTHER PUBLICATIONS

Manual of Steel Construction, pp. 5-116-5-119, (6th edition).

*Primary Examiner*—Martin P. Schwadron
*Assistant Examiner*—Abraham Hershkovitz
*Attorney, Agent, or Firm*—Brady, O'Boyle & Gates

[57] ABSTRACT

A self-aligning and end fixity connector for connecting a hydraulic cylinder piston rod to its respective section in a multi-section telescopic boom assembly wherein a pair of rectangular plates are secured to the free end of the piston rod, the plates being received in retainers secured to the boom section to thereby prevent the piston rod from rotating and thus providing end fixity to the rod. A clearance is provided between the plates and the retainers to allow a slight floating action of the rod in a vertical plane so that the rod connection point is substantially in alignment with the cylinder connection point to allow full retraction without binding of the boom sections.

6 Claims, 5 Drawing Figures

SELF-ALIGNING AND END FIXITY CONNECTOR FOR CONNECTING A HYDRAULIC CYLINDER PISTON ROD TO ITS RESPECTIVE SECTION IN A MULTI-SECTION TELESCOPIC BOOM ASSEMBLY

This is a continuation of application Ser. No. 511,606, filed Oct. 3, 1974, now abandoned.

In multi-section telescopic boom assemblies, it is conventional to mount the respective hydraulic rams employed for extending and retracting each boom section in such a manner that the ram cylinder is mounted within and connected to one boom section which telescopically supports the next adjacent boom section to which the ram piston rod is connected. Since the cylinder is connected to one boom section and the piston rod is connected to another boom section, in order that there is no binding of the boom sections during the retraction thereof, there is a necessity to maintain a proper alignment between the respective points of connection of the cylinder to its boom section and of the rod to its boom section.

Heretofore, when the cylinder and rod components were pinned to their respective boom sections, the center lines of the two pinned connections became out of alignment which resulted in the binding of the boom sections thus preventing full retraction of one boom section within another. To provide the full retraction without binding, manufacturing tolerances had to be kept very small and strictly adhered to, until the industry went to a floating-type rod connection to overcome increased manufacturing costs of adhering to the required small manufacturing tolerances. The floating rod connection included a spring loaded roller bearing mounted on the end of the piston rod, and movable in a slot formed in a block mounted on the boom section. While this floating rod arrangement provided the necessary alignment between the cylinder connection and the rod end connection, the rod end connection was not maintained fixed; thus, the piston rod had a tendency to rotate about the horizontal transverse axis of the roller bearing.

It is well known in the stress art that column-loading can be greatly increased in a column when both ends of the column have end fixity. Thus, the column-loading of a multi-section boom has heretofore been somewhat limited due to the non-fixity of the floating rod connection.

After considerable research and experimentation, the rod connection of the present invention has been devised to not only provide the proper alignment between the cylinder connection and the rod connection but also to provide a fixity to the rod end whereby the column loading of the boom assembly is substantially enhanced.

The self-aligning and end fixity connector of the present invention comprises, essentially, a pair of rectangular plates secured to the free end of the piston rod, the plates being received in retainers secured to a boom section to thereby prevent the piston rod from rotating and thus providing end fixity to the rod. A clearance is provided between the plates and the retainers to allow a slight floating action of the rod in a vertical plane so that the rod connection point is substantially in alignment with the cylinder connection point to allow full retraction without binding of the boom sections.

In the drawings:

FIG. 1 is a fragmentary, sectional side elevational view of a multi-section boom assembly employing the self-aligning and end fixity connector of the present invention;

FIG. 1*a* is a fragmentary, sectional, side elevational view of a multi-section boom assembly with the hydraulic rams removed therefrom to show the retainer plates employed in the connector of the present invention;

Figure 1:
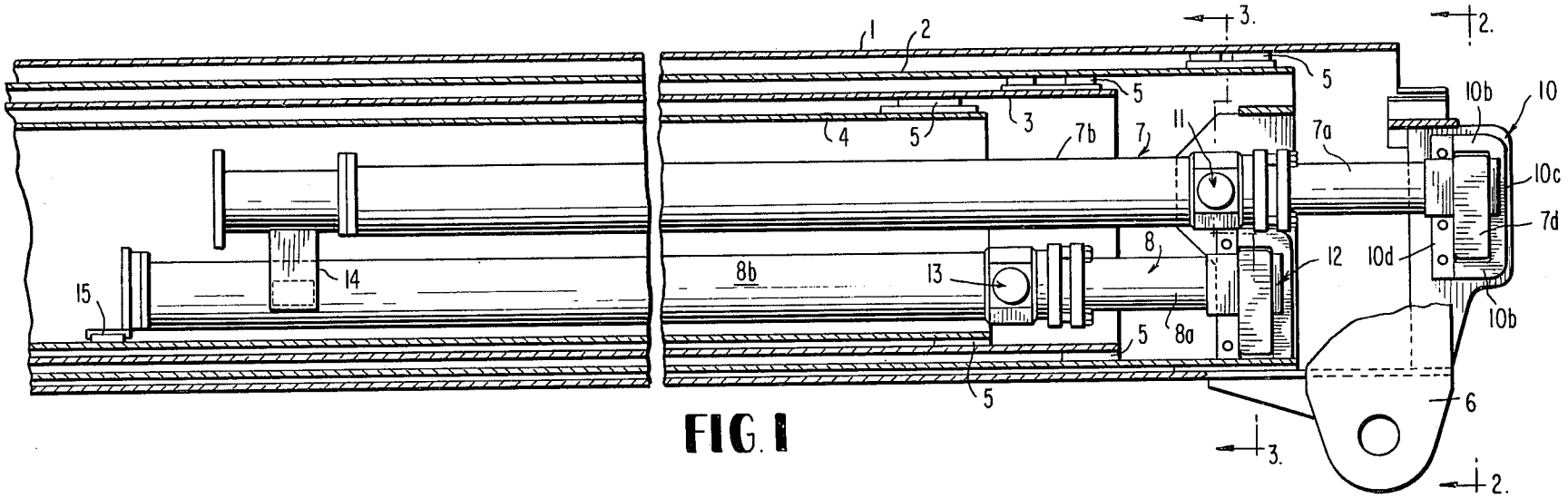

Referring to the drawings and more particularly to FIG. 1, multi-section telescopic boom assemblies, such as, four-section assemblies, include a base section 1 slidably receiving an inner mid section 2 which, in turn, slidably receives an outer mid section 3 which slidably receives a fly section 4, the sliding movement between adjacent sections being facilitated by suitable bearing pads 5. The base section 1 is provided with a bracket 6 through which the boom assembly is pivotally connected to a support platform (not shown) for movement in a vertical plane to elevate and lower the boom assembly. Hydraulic rams are usually provided for this movement of the boom assembly in the vertical plane, and additional hydraulic rams are provided for telescopically moving the boom sections with respect to each other. While FIG. 1 shows only rams 7 and 8 for respectively moving the inner mid section 2 relative to the base section 1, and the outer mid section 3 relative to the inner mid section 2, it will be understood by those skilled in the art that another hydraulic ram is connected between the outer mid section 3 and the fly section 4 for sliding the fly section relative to the outer mid section. The rod end 7*a* of ram 7 is connected to the base section 1 as at 10 and its cylinder 7*b* is connected to the inner mid section 2 as at 11. The ram 8 is similarly connected to the inner and outer mid sections at 12 and 13, respectively. By this construction and arrangement, when the rams are actuated to either extend or retract the boom sections, the rods 7*a* and 8*a* are maintained substantially stationary and the cylinders 7*b* and 8*b* are caused to slide relative to their respective rods, the sliding movement of the cylinders with respect to each other and the boom sections being facilitated by suitable skids 14 and 15.

Figure 1A:
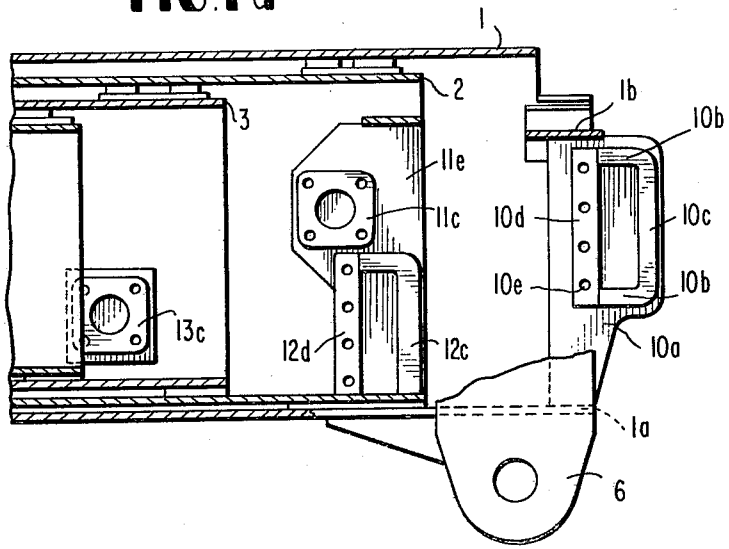
Figure 4:
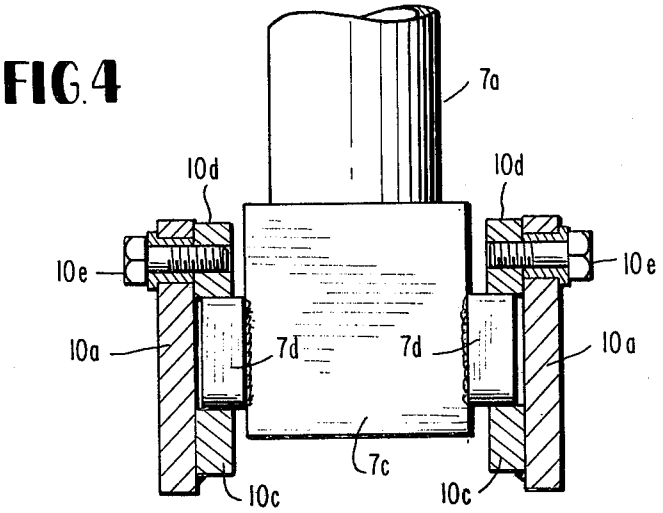
FIG. 4 is a view taken along line 4—4 of FIG. 2.
Figure 2:
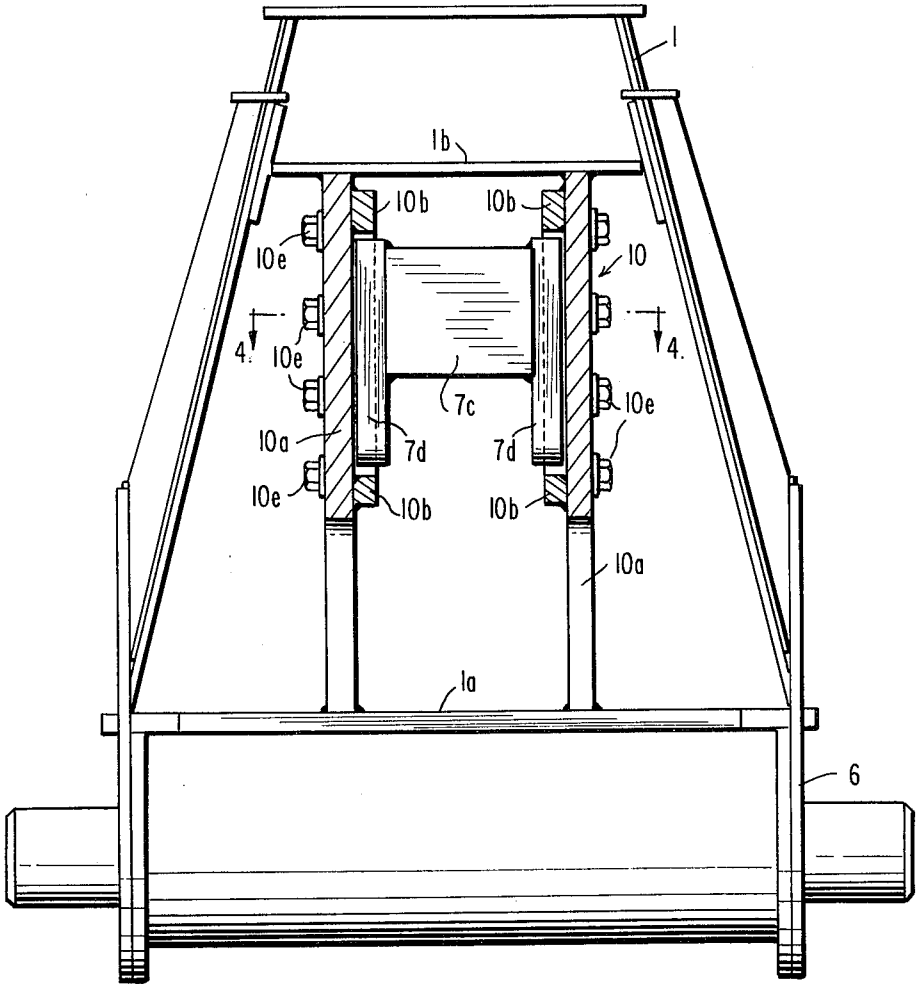
FIG. 2 is a view taken along line 2—2 of FIG. 1.

The details of the construction of rod end connection 10 are illustrated in FIG. 2, wherein it will be seen that a pair of spaced, parallel plates 10*a* are positioned between and welded to the bottom wall 1*a* of boom section 1 and a top wall 1*b* extending between the side walls of the boom base section. The free end of the piston rod 7*a* is provided with a block member 7*c* having depending plate members 7*d* welded to the side faces thereof and disposed adjacent the inwardly facing sides of the plates 10*a*. The plate members 7*d* are positioned within recesses formed by rectangular frame members having integral end and side walls 10*b*, 10*c*, FIG. 1*a*, welded to the inwardly facing sides of the plates 10*a*, the plate members 7*d* being retained in the recesses by side walls 10*d* secured to the side plates 10*a* by suitable bolts 10*e*. While the side edges of the rod plates 7*d* engage the corresponding side walls 10*c* and 10*d* of the rectangular frame members, as seen in FIG. 4, there is a slight clearance between the upper and lower edges of the plates and the end walls 10*b* as shown in FIG. 2.

Figure 3:
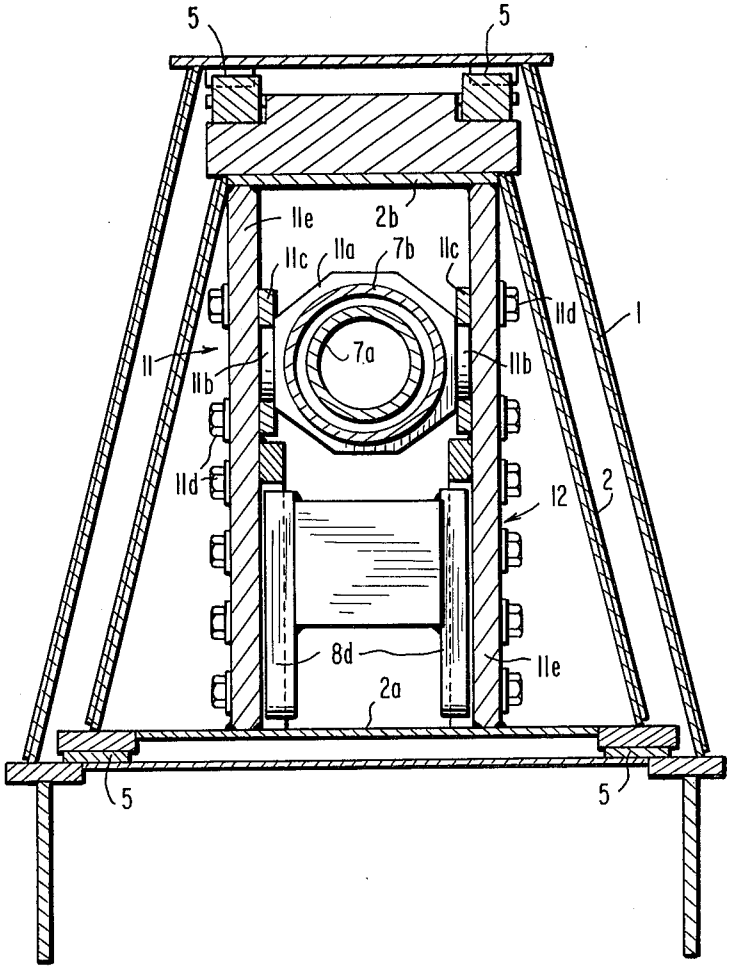
FIG. 3 is a view taken along line 3—3 of FIG. 1.

Referring to FIGS. 1*a* and 3, the connection 11 through which the ram cylinder 7*b* is connected to the inner mid section 2 comprises a collar 11*a* secured to the outer surface of the cylinder 7*b* and having trunnions 11*b* mounted within circular apertures formed in plates 11*c*. The plates 11*c* are secured by bolts 11*d* to the inwardly facing sides of spaced, parallel plates 11*e* positioned between and welded to the bottom wall 2*a* and top wall 2*b* of boom section 2.

The connections for securing ram 8 to its respective boom sections are identical to those described above with regard to the connections for ram 7; suffice it to say that the depending rectangular plates 8*d* are received within the recesses formed by the frame members 12*c*, 12*d*, FIG. 1*a*, secured to the inwardly facing side walls of plates 11*e*, and the ram cylinder 8*b* is trunnioned to boom section 3 through apertured plates 13*c* secured to the side walls of the outer mid section 3. In the rod connection shown at 12, since the frame member 12*c* is located adjacent the bottom wall of the inner mid-section 2 the bottom wall of the boom section 2 functions as one end wall portion of the frame member 12*c* so that this frame member is L-shaped rather than C-shaped according to frame member 10*b*, 10*c*. With this arrangement, removable frame member 12*d* is also shorter in length than comparable frame member 10*d* of connection 10, but the recesses formed for the plate members 7*d* and 8*d* within the respective frame members are of the same size such that these plate members 7*d* and 8*d* are free to slide, very slightly, up and down in the vertical direction relative to the side walls of the frame members 10*c*, 10*d* and 12*c*, 12*d*, respectively, to allow slight floating action of the rod ends in vertical plane so that the rod connection is maintained in substantial alignment with the cylinder connection point without binding during operation of boom.

From the above description, it will be readily apparent to those skilled in the art that the rod end connections 10 and 12 provide an end fixity to their respective piston rods 7*a* and 8*a* since the plate members 7*d* and 8*d* are retained within their respective recesses and since the piston on the rods extend somewhat inside the cylinder, the piston rods are prevented from rotating. Thus by substantially fixing opposite ends of the ram piston rods in this manner, the column loading of the rods and associated boom sections is greatly increased.

The embodiments of the invention in which an exclusive property or privilege is claimed are defined as follows:

1. A self-aligning and end fixity connector for connecting a hydraulic cylinder piston rod to its respective section in a multi-section telescopic boom assembly comprising, a hydraulic cylinder mounted within one section of a multi-section boom assembly, a member connected to the cylinder and trunnioned to the boom section for pivotal movement only relative thereto, a piston rod slidably mounted in said cylinder, a piston on one end of said rod disposed within said cylinder, a block member rigidly connected to the free end of said piston rod, a pair of spaced, parallel, depending plate members secured to the side faces of said block, said depending plate members being positioned adjacent the inwardly facing surfaces of the side walls of another section of said multi-section boom assembly, a rectangular frame member having integral end and side walls secured to each inwardly facing side wall, each rectangular frame member and the respective inwardly facing side wall forming a recess receiving a respective depending plate member, each depending plate member on the free end of the piston rod being rectangular, the side edges of each depending plate member engaging the corresponding side edges of the frame to prevent rotation of the piston rod about a horizontal transverse axis, the end edges of each depending plate member being spaced from the corresponding ends of the frame member to thereby provide a clearance for permitting a floating action of the rod in a vertical plane only, whereby the connection points of the cylinder and piston to their respective boom sections are maintained in alignment with each other, with the opposite ends of the piston rod substantially fixed against rotational movement about a horizontal transverse axis, thereby increasing the column loading capacity of the rod and associated boom section.

2. A self-aligning and end fixity connector according to claim 1 wherein the rectangular frame member has opposite end walls integrally connected to one side wall, the other side wall of the rectangular frame member being detachably connected to the face of the side wall.

3. A self-aligning and end fixity connector according to claim 1 wherein the respective boom section walls comprise a pair of spaced, parallel plate members connected between a bottom and top wall of the boom section.

4. A self-aligning and end fixity connector according to claim 1 wherein the member for connecting the cylinder to the first-mentioned boom section comprises a collar connected to the cylinder and trunnioned to the boom section.

5. A self-aligning and end fixity connector according to claim 4 wherein the trunnion connection comprises a pair of apertured plates connected to opposite walls of the first-mentioned boom section, said collar having trunnions received in said apertured plates.

6. A self-aligning and end fixity connector according to claim 5 wherein the opposite walls of the first-mentioned boom section comprise a pair of spaced, parallel plates connected between the bottom and top walls of the first-mentioned boom section, said plates also supporting the rectangular frame for the free end of another piston rod in the multi-section boom assembly.

* * * * *